United States Patent [19]

Howard et al.

[11] 4,139,959

[45] Feb. 20, 1979

[54] CARTRIDGE MAGAZINE

[76] Inventors: William J. Howard, P.O. Box 573; William A. Harvey, P.O. Box 3065, both of Wilson, N.C. 27893

[21] Appl. No.: 796,560

[22] Filed: May 13, 1977

[51] Int. Cl.[2] ..... F41C 25/02

[52] U.S. Cl. ..... 42/50

[58] Field of Search ..... 42/50, 6, 7, 18, 22

[56] References Cited

U.S. PATENT DOCUMENTS

| | | | |
|---|---|---|---|
| 3,440,751 | 4/1969 | Fremont | 42/50 |
| 3,453,762 | 7/1969 | Fremont | 42/50 |
| 3,619,929 | 11/1971 | Fremont | 42/50 |
| 3,726,038 | 4/1973 | Bredbury | 42/50 |

*Primary Examiner*—Charles T. Jordan

[57] ABSTRACT

A cartridge magazine comprises a curved, molded, plastic case with a spring-pressed follower to urge the stack of cartridges therein toward the upper end for ejection. This follower is pivoted on the end of the spring for forward and backward angular movement, and has a post on its forward end to engage the spring.

A closure plate on the lower end of the case includes a latch which is retained against release by the post on the follower when the follower is at the lower end with the magazine filled with cartridges.

4 Claims, 13 Drawing Figures

Fig 9.
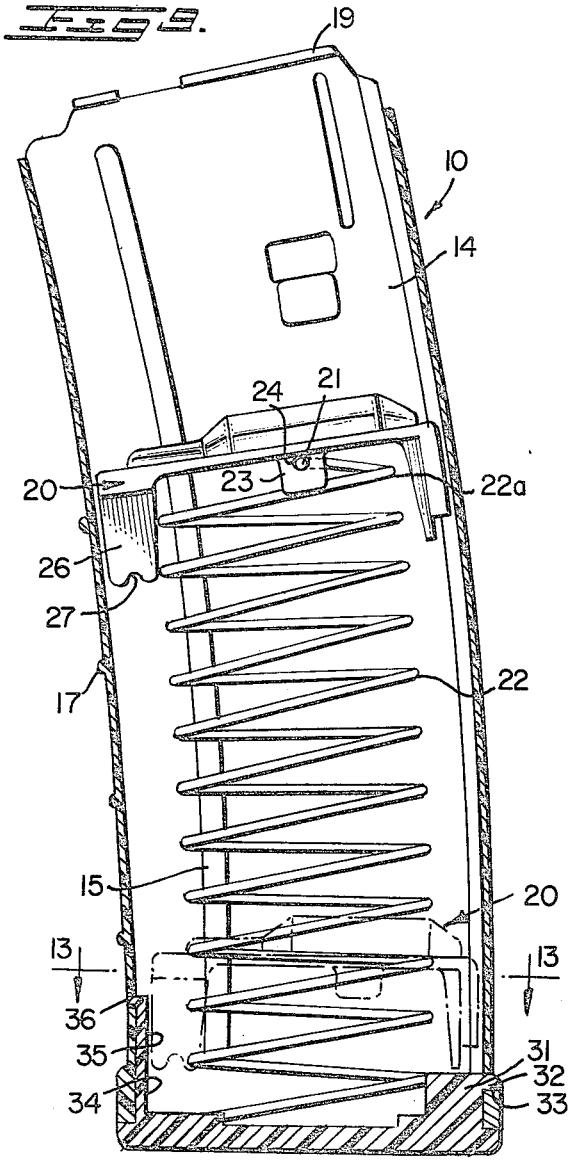
Fig 3.
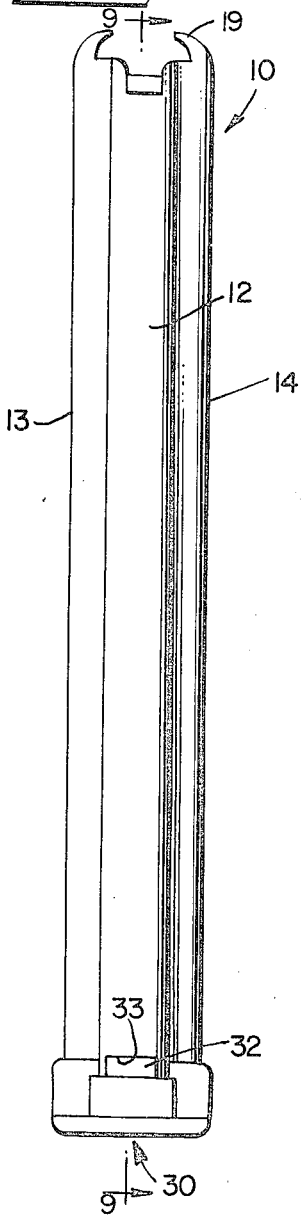
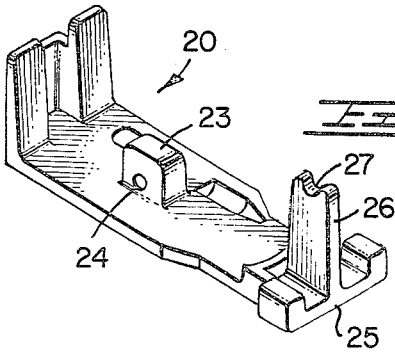
Fig 7.
Fig 8.
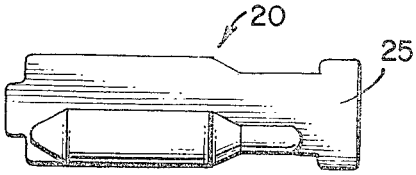

CARTRIDGE MAGAZINE

This invention relates to a cartridge magazine, especially a magazine for supplying cartridges to a rifle to which it may be attached. The novel magazine has been developed for economical production and is constructed so as to avoid problems arising with some earlier magazines.

BACKGROUND OF ART

A number of types of magazines have been devised, a few of which are listed here as representative and as closest to applicant's magazine:

U.S. Pat. Nos.:

3,440,751, Fremont, Apr. 29, 1969

This magazine is formed with a rectangular, metal case, curved at its central section with straight ends. A rectangular follower is spring-pressed and guided in the case, and is mounted for slight tilting movement on the end of the spring.

3,453,762, Fremont, July 8, 1969

This magazine is formed with a molded plastic case, with the curved lips at the top restricting ejection of the cartridges and the rectangular spring-pressed follower to urge the cartridges upwardly.

3,726,038, Bredbury, Apr. 10, 1973

This patent shows a follower fixed on the end turn of the coil spring, so it may tilt with the end of the spring as it approaches the top of the magazine.

Because of the use and mistreatment to which these magazines are subjected, especially in the field, problems of misfunction sometimes arise. One troublesome misfunction may be caused by depression of the follower, as by insertion of a single cartridge, so that the follower engages the case and does not return to normal position. This and improper displacement of the cartridges may prevent proper movement of the cartridges into the rifle, so that the rifle becomes useless at a critical time. Because of the frequently unskilled personnel involved, and the often unusual conditions of weather and dirt, every possibility of improper operation must be eliminated where possible.

SUBJECT MATTER AND PURPOSE OF PRESENT INVENTION

Applicant has found that an economical case for the magazine may be molded out of certain plastic material which will withstand the stresses to which the magazine is subjected. While various plastic materials may be used, a satisfactory plastic material for this purpose is 77 G Series by Dupont, which is 43% fiberglass-filled nylon. This case is curved longitudinally so the front and rear walls are on a radius, with the ribs inside formed by external grooves on the same radius, to conform to the stack of cartridges in the magazine, which are smaller at the nose ends than at the rear. This uniform curvature also provides for molding the case and its separation from the mold parts.

The side walls of the case are also formed with a series of external transverse ribs which reenforce the casing and are arranged so that with the grooves they present a distinctive appearance.

An important feature of the invention resides in the follower, which is rectangular to conform to the rectangular casing. This follower is pivoted on the upper end of the spring, so that it may tilt either forwardly or rearwardly without binding in the case. Any excessive forward tilting is resisted by a post on the front end of the follower which engages a coil of the coil spring to return it from its angular position. The forward corners of the follower are beveled or chamfered, with sufficient clearance of the front wall of the casing that no binding can occur.

Another feature is a closure for the bottom end of the case. This closure or floor plate is fastened to the case by an integral stud in engagement with the rear wall of the case and a resilient latch engaging the front wall. This latch is so positioned that the follower and post lie closely to the rear side of the latch and prevent its release when the follower is at the lower end of the case in a full magazine.

DRAWINGS

FIG. 3 is a rear elevation view of the magazine.

FIG. 7 is a bottom perspective view of the follower.

FIG. 8 is a top plan view of the follower.

FIG. 9 is a vertical cross-sectional view taken along line 9—9 of FIG. 3 showing the follower and spring within the casing.

DESCRIPTION OF INVENTION

Figure 1:
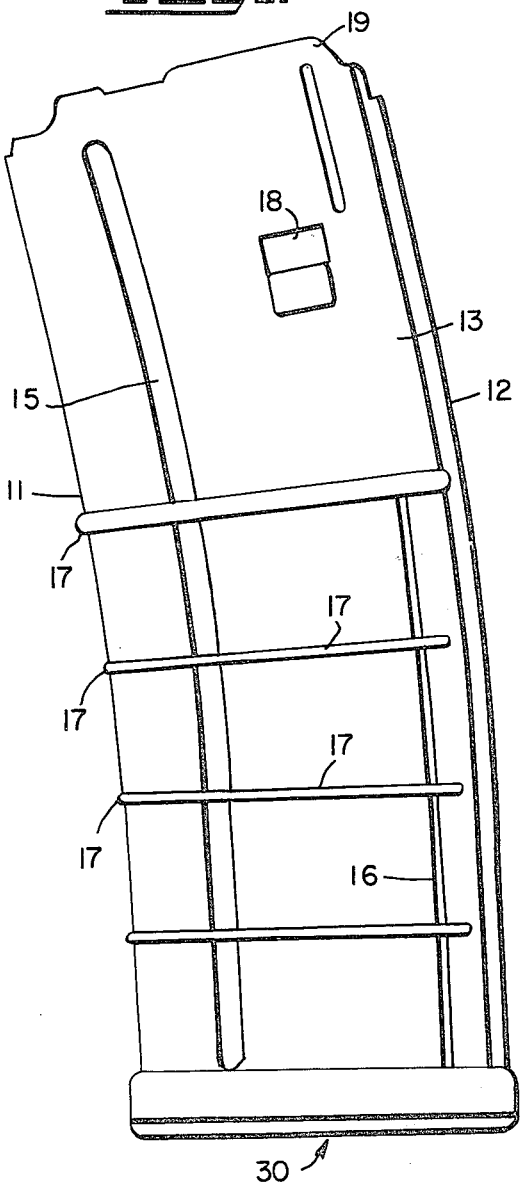
FIG. 1 is a side elevation view of the magazine of this invention.
Figure 2:
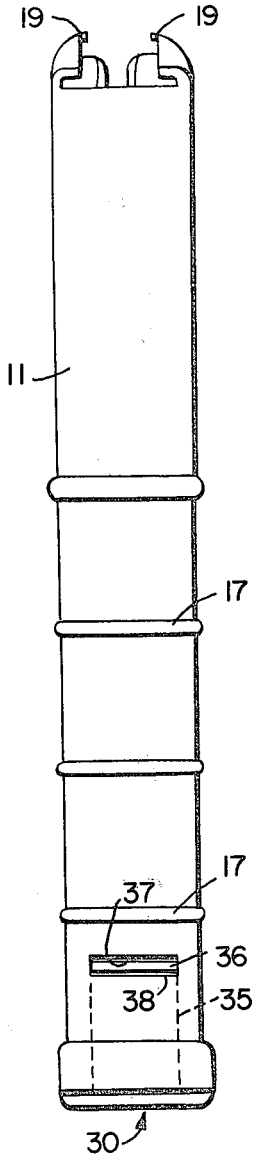
FIG. 2 is a front elevation view of the magazine.
Figure 5:
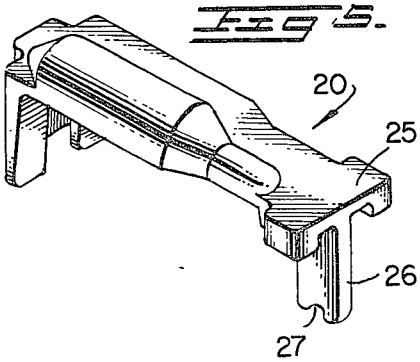
FIG. 5 is a top perspective view of the follower element.
Figure 6:
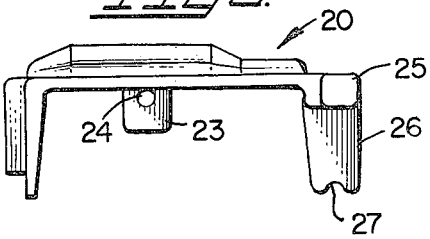
FIG. 6 is a side elevation view of the follower.
Figure 10:
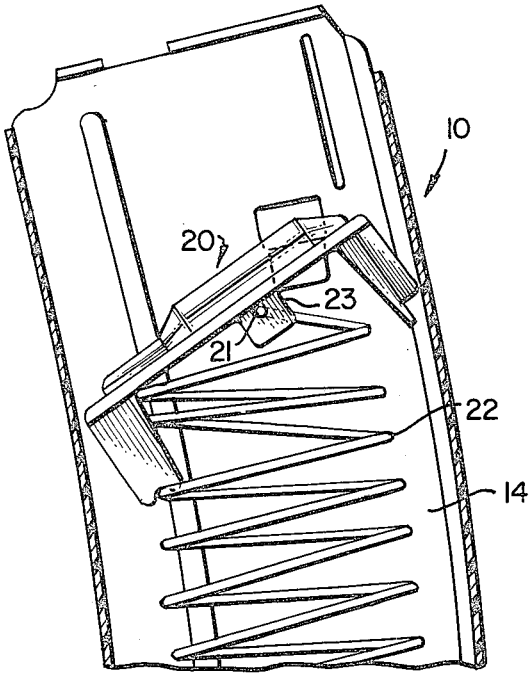
FIG. 10 is a vertical cross-sectional view similar to FIG. 9 showing the follower in a tilted position within the magazine.
Figure 4:
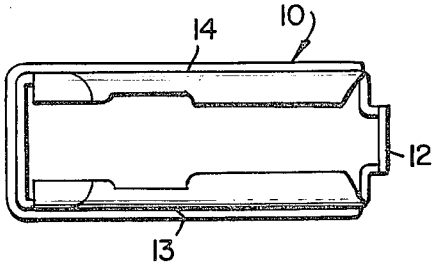
FIG. 4 is a top plan view of the magazine.
Figure 11:
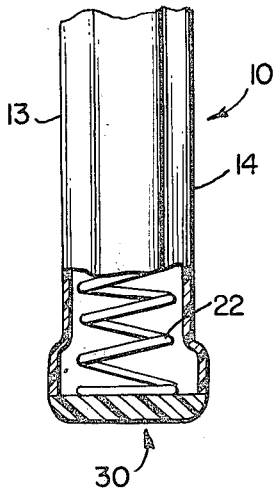
FIG. 11 is a fragmentary elevation view of FIG. 3 partially broken away to show the bottom closure plate.
Figure 12:
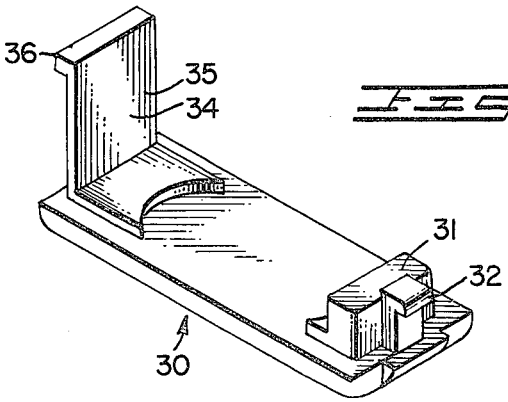
FIG. 12 is a perspective view of the bottom closure plate.
Figure 13:
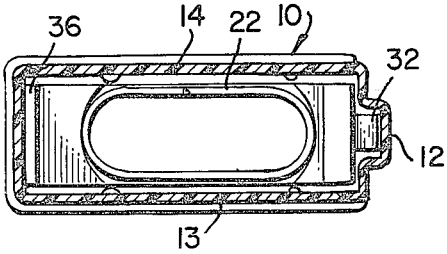
FIG. 13 is a transverse detailed sectional view taken along line 13—13 of FIG. 9 showing the closure plate with the spring seated thereon.

The casing 10 for the magazine of this invention is constructed of molded plastic and is formed with radially curved front and rear walls 11 and 12 with flat side walls 13 and 14. This case has inwardly curved lips 19 on the top side ends of the side walls, these lips extending substantially the width of the casing between the front and rear walls, with space at the front of the case for ejection of a cartridge.

The side walls of the case are formed with grooves as shown at 15, 16 to provide internal ribs in the case, these grooves and ribs being on the same radius as the walls 11 and 12, so that the mold parts may be separated in the molding process. The sides and front wall of the case are also provided with transverse ribs 17, which act to reenforce the case and are arranged to present a distinctive appearance. The top rib on the front wall or on the side walls may act as a stop for insertion into a rifle as is known in the art. See U.S. Pat. No. 3,453,762. The opening 18 to receive a latch on the rifle is also similar to that shown in this patent.

The stack of cartridges in the magazine is urged toward the top end by a spring-pressed follower 20. This rectangular follower is pivoted on the transverse bent end 21 of an oval coil spring 22, the follower having a central stud 23 on its under side with an opening 24 receiving the end of the spring. The end 21 of the spring is bent up to allow sufficient space between the follower and the top coil 22*a* of spring 22 so that the follower may pivot downwardly, both forwardly and backwardly, from its horizontal position. The forward end of the follower at the top is curved or beveled at 25 with sufficient clearance from the front wall 11 to allow forward pivotal movement.

On the front end of follower 20 is a downwardly extending central integral post 26 which has a curved notch 27 on its lower end and is so constructed that, upon excessive downward forward pivotal movement of the follower, the post will engage a coil of spring 22, so that the spring will have a tendency to resist excessive downward movement of the forward end of the follower.

The bottom end of the case 10 is closed by an end or floor plate 30, upon which the bottom end of spring 22 is seated. This floor plate is rectangular to conform to the end of the case and has fastening means for securing it to the case. On the forward end of the plate a vertical integral stud 31 is formed with a lateral lug 32 which fits into an opening 33 in the rear wall 12 of the case. On the forward end of the floor plate 30 is fixed a releasable latch 34, which includes an upwardly extending, resilient tongue 35 having a lug 36 at its top end to engage in an opening 37 in the front wall, the lower side of the opening forming a shoulder 38 which is engaged by the lug 36 to retain the plate on the case.

The follower 20 may be moved downwardly compressing the spring 22 when the case is filled with cartridges. In its lowest position in the filled magazine, the post 26 of follower 22 is positioned close to and in the rear of the latch 34, so that the post 26 blocks the release of latch 34.

The construction of the follower eliminates all possibility of misfunction which may result from the follower being improperly positioned in the case. As the follower is arranged to tilt freely on the end of the coil spring and is provided with curved surfaces and substantial clearance in the case, improper action is unlikely. The forward post, which is engaged by a spring coil under unusual displacement of the follower, assures the proper positioning of the follower under any condition. Also, the magazine is always ready for operation by retaining the cover plate properly closed. Improper operation is therefore avoided, so that the rifle will function properly in crucial actions.

We claim:

1. A cartridge magazine comprising a molded case of plastic material rectangular in cross-section with side walls and front and rear walls radially curved from end to end, said case being open at the top with curved inwardly projecting lips on the side walls extending from adjacent the rear wall to the front wall with sufficient space for emergence of a cartridge, a floor plate closing the bottom of said case, and an oval coil spring substantially rectangular in plan to conform to the shape of said rectangular case seated on said floor plate, a rectangular follower connected to the opposite end of said spring and movable by said spring toward the top end of said case to urge cartridges therein toward said top end, the top end of said spring forming a transverse pivot on which said follower is pivotally mounted at its center and spaced from the adjacent spring coil for free angular movement both forwardly and rearwardly from its horizontal position, said follower being rounded at its forward end and upper surface to provide sufficient clearance for such pivotal action between the end of the follower and said front wall of the case, said follower having a downwardly extending post on its front end constructed and positioned to engage a coil of said spring upon abnormal forward and downward angular movement of said follower to avoid possible misfunction of said follower, and fastening means for connecting said floor plate with its spring seat to said case, including a stud on the rear end of said floor plate with a rearwardly extending lug engaging in an opening in the rear wall of said case and a releasable latch having an upwardly extending resilient tongue on the front end of said plate with a lug on the upper end of said tongue engaging in an opening in the front wall of said case, said follower being movable downwardly in said case to adjacent said floor plate with said post on said follower positioned close to and in the rear of said latch so that movement of said latch to release said floor plate is blocked when said follower is at the bottom end of the case when said case is filled with cartridges.

2. A cartridge magazine comprising a molded case of plastic material rectangular in cross section with side walls and front and rear walls, said case being open at the top with curved inwardly projecting lips on the side walls, a floor plate closing the bottom of said case, an oval coil spring substantially rectangular in plan seated on said floor plate, a rectangular follower pivoted at its center on the opposite end of said spring and spaced from the adjacent spring coil for angular movement, both forwardly and rearwardly, from its horizontal position, said follower having a downwardly extending post on its front end constructed and positioned to engage a coil of said spring upon abnormal forward and down angular movement of said follower to avoid possible misfunction of said follower, and fastening means for connecting said floor plate with its spring seat to said case, including a releasable latch having an upwardly extending resilient tongue on the front end of said plate with a lug on the upper end of said tongue engaging a shoulder on the front wall of said case, said follower being movable downwardly in said case to adjacent said floor plate with said post on said follower positioned close to and in the rear of said latch so that movement of said latch to release said floor plate is blocked when said follower is at the bottom end of the case when said case is filled with cartridges.

3. A cartridge magazine comprising a case rectangular in cross-section with side walls and front and rear walls and open at the upper end, a floor plate closing the bottom of said casing, a spring seated on said floor plate, a follower connected to the upper end of said spring and movable from a position adjacent said floor plate when said spring is compressed to urge cartridges toward the upper end of said case, and fastening means for connecting said floor plate to said case, including a releasable latch having an upwardly extending resilient tongue on the front end of said plate with a lug on the upper end of said tongue engaging a shoulder on the front wall of said case, said follower in its position adjacent said floor plate having a portion close to and in the rear of said tongue to block release movement of said latch.

4. A cartridge magazine comprising a case rectangular in cross-section with side walls and front and rear walls, said case being open at the top with curved inwardly projecting lips on the side walls, a substantially oval coil spring in said casing, a rectangular follower pivoted at its center on the top end of said spring and spaced from the adjacent spring coil for angular movement, both forwardly and rearwardly, from its horizontal position, said follower having a downwardly extending post on its front end constructed and positioned to engage a coil of said spring upon abnormal forward and downward angular movement of said follower to avoid possible misfunction of said follower.

* * * * *